US010658775B2

(12) United States Patent
Lin et al.

(10) Patent No.: US 10,658,775 B2
(45) Date of Patent: May 19, 2020

(54) ELECTRICAL CONNECTOR DIRECTLY CONNECTING AN ELECTRONIC COMPONENT TO A CIRCUIT BOARD

(71) Applicant: LOTES CO., LTD, Keelung (TW)

(72) Inventors: Chin Chi Lin, Keelung (TW); Zuo Feng Jin, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/392,835

(22) Filed: Apr. 24, 2019

(65) Prior Publication Data

US 2019/0326692 A1 Oct. 24, 2019

(30) Foreign Application Priority Data

Apr. 24, 2018 (CN) ..... 2018 1 0372378

(51) Int. Cl.
*H01R 12/72* (2011.01)

(52) U.S. Cl.
CPC ..... *H01R 12/721* (2013.01)

(58) Field of Classification Search
CPC ..... H01R 12/55; H01R 12/721; H01R 12/71; H01R 12/585; H01R 43/16
USPC ..... 439/66, 629
See application file for complete search history.

(56) References Cited

U.S. PATENT DOCUMENTS 6,280,254 B1 * 8/2001 Wu ..... H01R 13/2442 439/515
6,315,621 B1 * 11/2001 Natori ..... H01R 13/2428 439/862
7,052,284 B2 * 5/2006 Liao ..... H01R 13/2435 439/66
7,189,080 B2 * 3/2007 Tang ..... H01R 13/2435 439/66
7,198,493 B2 * 4/2007 Chen ..... H01R 13/2442 439/66
7,220,152 B2 * 5/2007 Jeong ..... H01R 13/2421 439/862
7,435,100 B2 * 10/2008 Chang ..... H01R 13/2435 439/66

(Continued)

FOREIGN PATENT DOCUMENTS

CN 201204289 Y 3/2009
CN 201266710 Y 7/2009
CN 202585853 U 12/2012

*Primary Examiner* — Peter G Leigh
(74) *Attorney, Agent, or Firm* — Locke Lord LLP; Tim Tingkang Xia, Esq.

(57) ABSTRACT

An electrical connector is used to electrically connect an electronic component to a circuit board, and includes an insulating body, at least one first terminal and at least one second terminal. The first terminal has a first base accommodated in the insulating body and a first elastic arm extending upward from the first base. The first elastic arm is used to abut the electronic component. The second terminal has a second base soldered and fixed to the first base, and a second elastic arm extending from the second base toward the first elastic arm. The second elastic arm upward abuts the first elastic arm. A lower end of the first base is provided with a first conduction portion to be electrically connected to the circuit board. A projection of the first conduction portion and a projection of the first elastic arm in a vertical direction are at least partially overlapped.

16 Claims, 10 Drawing Sheets

(56) References Cited

U.S. PATENT DOCUMENTS

| | | | | |
|---|---|---|---|---|
| 7,455,556 | B2 * | 11/2008 | Mendenhall | H01R 12/57 439/495 |
| 7,467,949 | B2 * | 12/2008 | Liao | H01R 13/2435 439/66 |
| 7,530,820 | B2 * | 5/2009 | Jeon | H01R 12/57 29/832 |
| 7,534,113 | B2 * | 5/2009 | Liao | H01R 13/2442 439/83 |
| 7,559,811 | B1 * | 7/2009 | Polnyi | H01R 4/4809 439/591 |
| 7,563,105 | B2 * | 7/2009 | Liu | H01R 13/2492 439/66 |
| 7,625,216 | B2 * | 12/2009 | Mendenhall | H01R 13/2435 439/66 |
| 7,775,805 | B2 * | 8/2010 | Liao | H01R 13/2435 439/66 |
| 7,780,456 | B2 * | 8/2010 | Chen | H05K 7/1069 439/66 |
| 7,857,632 | B2 * | 12/2010 | Liu | H01R 13/2492 439/66 |
| 7,972,144 | B2 * | 7/2011 | Chang | H01R 4/02 439/66 |
| 8,123,574 | B2 * | 2/2012 | Ma | H01R 13/2442 439/862 |
| 8,888,502 | B2 * | 11/2014 | Terhune, IV | H01R 13/2407 439/66 |
| 8,888,525 | B2 * | 11/2014 | Yeh | H01R 13/17 439/539 |
| 9,088,084 | B2 * | 7/2015 | Liao | H01R 13/41 |
| 9,882,296 | B1 * | 1/2018 | Ju | H01R 12/7076 |
| 2009/0035995 | A1 * | 2/2009 | Chang | H01R 13/2492 439/630 |
| 2017/0365947 | A1 * | 12/2017 | Costello | H01R 13/2442 |

* cited by examiner

ELECTRICAL CONNECTOR DIRECTLY CONNECTING AN ELECTRONIC COMPONENT TO A CIRCUIT BOARD

CROSS-REFERENCE TO RELATED PATENT APPLICATION

This non-provisional application claims priority to and the benefit of, pursuant to 35 U.S.C. § 119(a), patent application Serial No. CN201810372378.2 filed in China on Apr. 24, 2018. The disclosure of the above application is incorporated herein in its entirety by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector for connecting a chip module to a circuit board by virtue of a terminal with dual conductive channels.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector has an insulating body, and multiple terminals are accommodated in the insulating body. Each terminal has a base accommodated in the insulating body. A main elastic arm extends upward to be above the insulating body from an upper end of the base. An upper end of the main elastic arm has a contact portion used to abut a chip module. An auxiliary elastic arm extends upward out of an upper surface of the insulating body from a lower end of the base. A free tail end of the auxiliary elastic arm has a contact abutting a lower side of the main elastic arm. When the chip module downward abuts the main elastic arm, the main elastic arm moves downward, and the auxiliary elastic arm slides along the main elastic arm and supports the main elastic arm. A conduction portion bends and extends from the base laterally. The conduction portion is electrically connected to a circuit board, such that the electrical connector can electrically connect the chip module and the circuit board.

However, the main elastic arm and the auxiliary elastic arm extend from the upper and lower ends of the base respectively. Thus, a connecting portion extends laterally from the base, and then the conduction portion extends downward from the connecting portion. The conduction portion and the main elastic arm are staggeredly provided in a vertical direction. After passing through the base, an electrical signal of a terminal can only be transmitted to the connecting portion and then transmitted to the conduction portion through the connecting portion. A conductive path for the electrical signal of the terminal turns at the connecting portion, and then the electrical signal is straightly transmitted to the circuit board through the conduction portion. Such design lengthens the conductive path for the electrical signal of the terminal, thereby resulting in signal losses during a transmission process, and deteriorating the electrical performance of the electrical connector.

Therefore, a heretofore unaddressed need to design a novel electrical connector exists in the art to address the aforementioned deficiencies and inadequacies.

SUMMARY

The present invention is directed to an electrical connector having a dual-conductive-channel terminal with a conductive path shorter than that in the related art.

To achieve the foregoing objective, the present invention adopts the following technical solutions. An electrical connector is configured to electrically connect an electronic component to a circuit board, and includes: an insulating body; at least one first terminal, having a first base accommodated in the insulating body and a first elastic arm extending upward from the first base, wherein the first elastic arm is configured to abut the electronic component; and at least one second terminal, having a second base soldered and fixed to the first base, and a second elastic arm extending from the second base toward the first elastic arm, wherein the second elastic arm upward abuts the first elastic arm; wherein a lower end of the first base is provided with a first conduction portion configured to be electrically connected to the circuit board, and a projection of the first conduction portion and a projection of the first elastic arm in a vertical direction are at least partially overlapped.

In certain embodiments, the first elastic arm has a first portion and a second portion sequentially from the base, the first portion bends and extends upward from the first base toward one side, the second portion bends and extends upward reversely from the first portion, and the first portion and the second portion form an accommodating space.

In certain embodiments, the second elastic arm has a third portion and a fourth portion, the third portion bends and extends upward from the second base, the fourth portion bends reversely and extends upward from the third portion, and the third portion and the fourth portion are at least partially accommodated in the accommodating space.

In certain embodiments, the first portion and the third portion are provided at least partially in parallel and spaced from each other to determine a first distance therebetween.

In certain embodiments, the second portion and the fourth portion are provided at least partially in parallel and spaced from each other to determine a second distance therebetween.

In certain embodiments, the first distance is same as the second distance.

In certain embodiments, the first elastic arm has an abutting region, the second elastic arm further has an abutting portion bending and extending upward from the fourth portion, and the abutting portion upward abuts the abutting region.

In certain embodiments, the first elastic arm further has a contact portion bending and extending upward from the second portion, and the abutting portion is provided adjacent to the contact portion.

In certain embodiments, the abutting region is provided on the second portion.

In certain embodiments, each of two sides of the first conduction portion is provided with at least one groove, a solder is attached to the first conduction portion, and the groove is located above the solder to accommodate a partially molten solder, to prevent the partially molten solder from climbing upward to the first base or the second base.

Another technical solution of the present invention may also be adopted as follows. An electrical connector is configured to electrically connect an electronic component to a circuit board, and includes: an insulating body; at least one first terminal, having a first base accommodated in the insulating body and a first elastic arm extending upward from the first base, wherein the first elastic arm is configured to abut the electronic component; and at least one second terminal, having a second base fixed to the first base, and a second elastic arm extending from the second base toward the first elastic arm, wherein the second elastic arm upward abuts the first elastic arm; wherein a lower end of the second base is provided with a conduction portion configured to be electrically connected to the circuit board, and a projection of the conduction portion of the second base and a projection of the second elastic arm in a vertical direction are at least partially overlapped.

In certain embodiments, a lower end of the first base is downward provided with a conduction portion, and the conduction portion of the first base and the conduction portion of the second base are attached to a same solder configured to be electrically connected to the circuit board.

In certain embodiments, at least one clamping arm extends from the conduction portion of the first base, the clamping arm, the conduction portion of the first base and the conduction portion of the second base define a clamping space, and the solder is located in the clamping space.

In certain embodiments, the first elastic arm has a first portion and a second portion sequentially from the base, the first portion bends and extends upward from the first base toward one side, the second portion bends and extends upward reversely from the first portion, and the first portion and the second portion form an accommodating space.

In certain embodiments, the second elastic arm has a third portion and a fourth portion, the third portion bends and extends upward from the second base, the fourth portion bends reversely and extends upward from the third portion, and the third portion and the fourth portion are at least partially accommodated in the accommodating space.

In certain embodiments, the first elastic arm has an abutting region, the second elastic arm further has an abutting portion bending and extending upward from the fourth portion, and the abutting portion upward abuts the abutting region.

Another technical solution of the present invention may also be adopted as follows. An electrical connector is configured to electrically connect an electronic component to a circuit board, and includes: an insulating body; at least one first terminal, having a first base accommodated in the insulating body and a first elastic arm extending upward from the first base, wherein the first elastic arm is configured to abut the electronic component; at least one second terminal, having a second base and a second elastic arm extending from the second base toward the first elastic arm, wherein the second elastic arm upward abuts the first elastic arm; and two fixing structures, configured to fix the first base and the second base, wherein the first base and the second base are located between the two fixing structures; wherein a lower end of the first base is provided with a first conduction portion configured to be electrically connected to the circuit board, and a projection of the first conduction portion and a projection of the first elastic arm in a vertical direction are at least partially overlapped.

In certain embodiments, two embracing arms respectively extend from two sides of the first base, and the two embracing arms fix the second base so as to form the two fixing structures.

In certain embodiments, two embracing arms respectively extend from two sides of the second base, and the two embracing arms fix the first base so as to form the two fixing structures.

In certain embodiments, the first elastic arm has a first portion and a second portion sequentially from the base, the first portion bends and extends upward from the first base toward one side, the second portion bends and extends upward reversely from the first portion, and the first portion and the second portion form an accommodating space; the second elastic arm has a third portion and a fourth portion, the third portion bends and extends upward from the second base, the fourth portion bends reversely and extends upward from the third portion, and the third portion and the fourth portion are at least partially accommodated in the accommodating space; and the first elastic arm has an abutting region, the second elastic arm further has an abutting portion bending and extending upward from the fourth portion, and the abutting portion upward abuts the abutting region.

Compared with the related art, in certain embodiments of the present invention, a projection of the first conduction portion (the conduction portion of the first base) and a projection of at least part of the first elastic arm are overlapped in the vertical direction, such that a connecting line between the first conduction portion (the conduction portion of the first base) and at least part of the first elastic arm is a vertical line perpendicular to the circuit board, thereby allowing the electrical signals to be straightly transmitted. Compared with the related art, the present invention enables the electrical signals to be directly conducted to a circuit board from a base vertically provided, so as to shorten a transmission path for the electrical signals.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
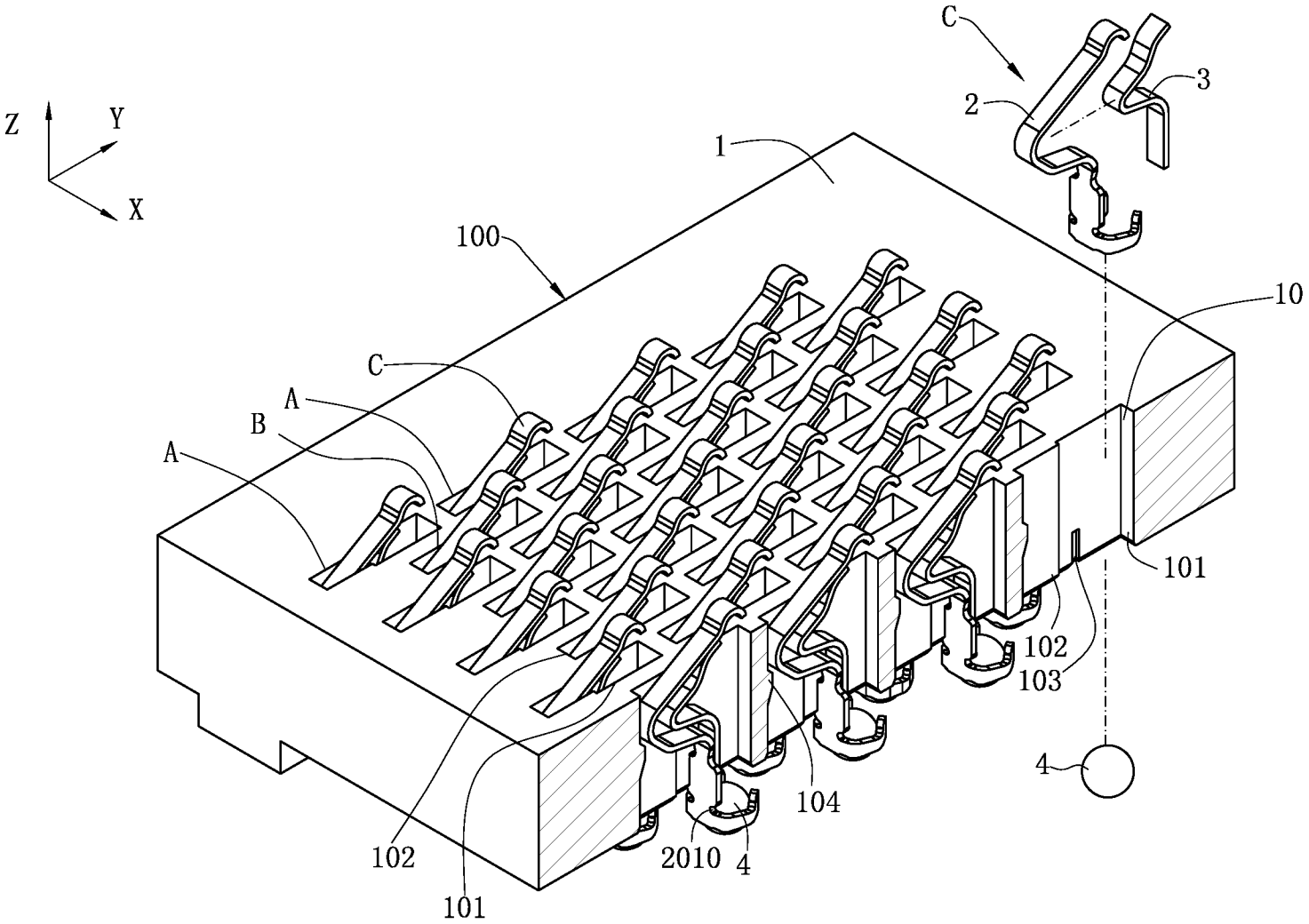
FIG. 1 is a perspective sectional view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector.

Figure 2:
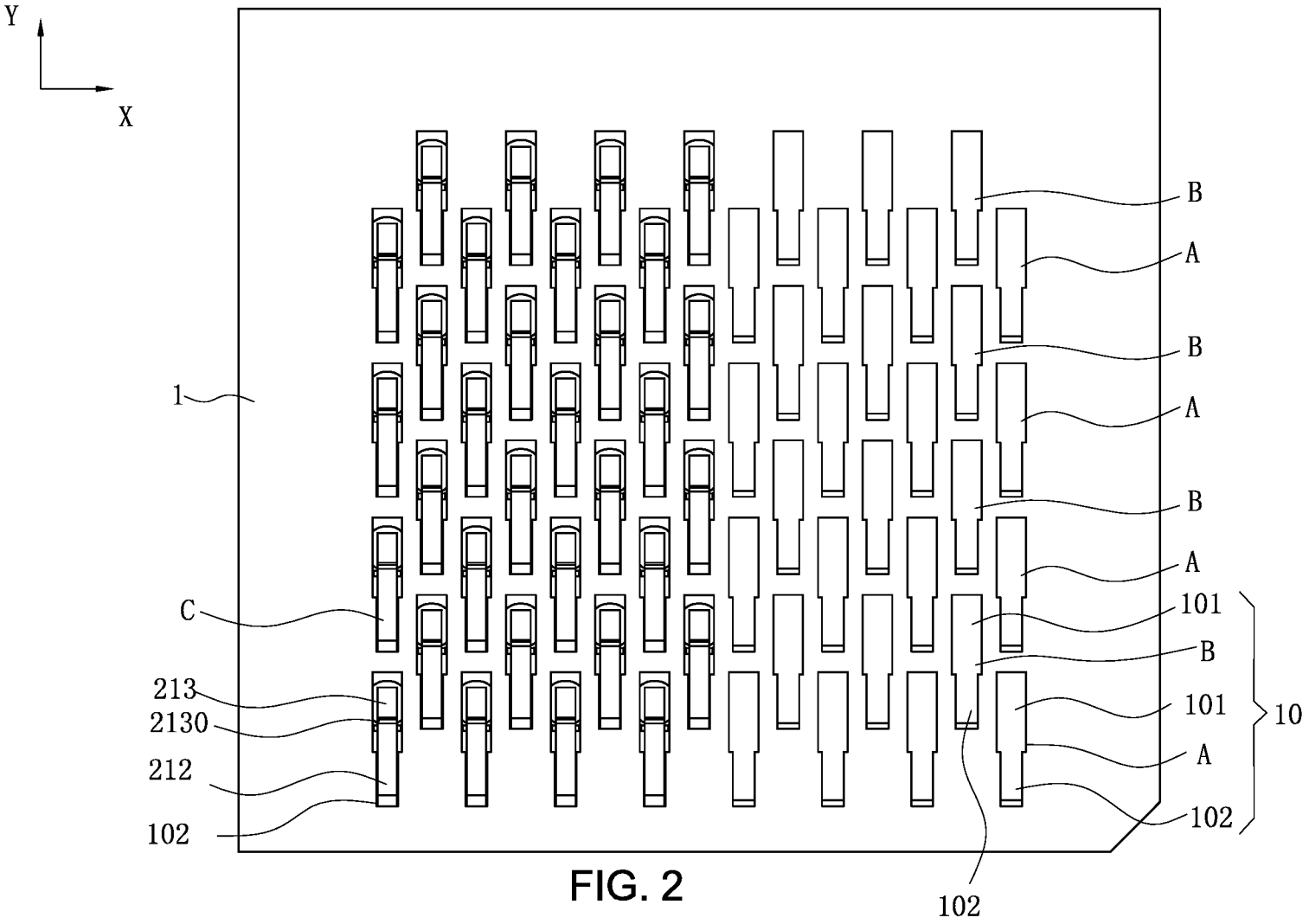
FIG. 2 is a top view of the electrical connector in FIG. 1.
Figure 3:
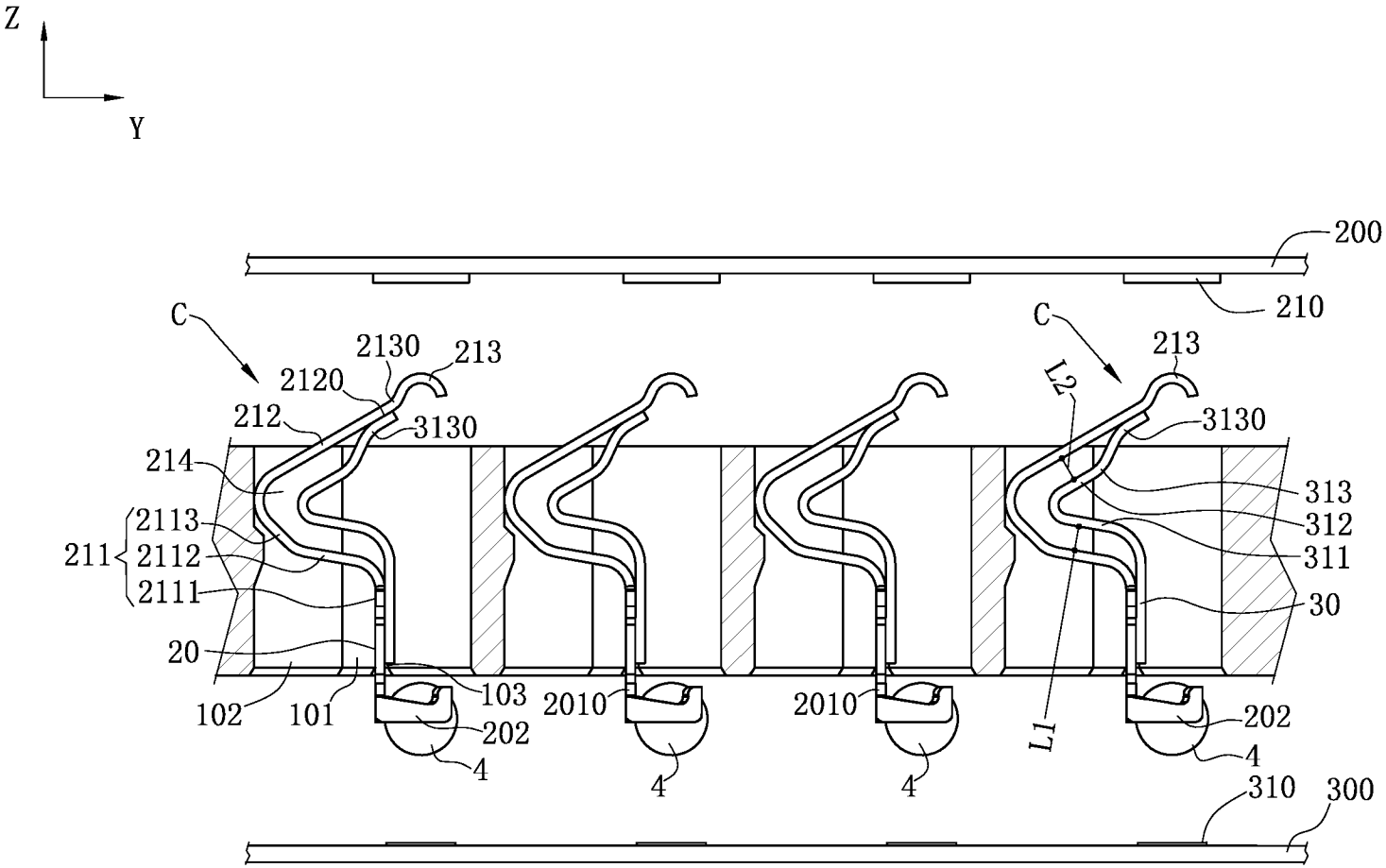
FIG. 3 is a plain sectional view of the electrical connector in FIG. 1.

FIG. 1, FIG. 2 and FIG. 3 show an electrical connector 100 according to a first embodiment of the present invention. The electrical connector 100 is mounted on a circuit board 300 in a vertical direction Z, and the circuit board 300 has multiple gaskets 301. The electrical connector 100 is mated with a chip module 200 in the vertical direction Z, and the chip module 200 is provided with multiple conductive sheets 210. The electrical connector 100 has an insulating body 1, and multiple terminals C are accommodated in the insulating body 1. An upper end of each terminal C is in electrical contact with a corresponding conductive sheet 210. A lower end of each terminal C matches with a solder 4, and the solder 4 is attached to a corresponding gasket 310, such that the terminal C is electrically connected to the gasket 310, thereby implementing the electrical connection of the electrical connector 100 between the circuit board 300 and the chip module 200.

Referring to FIG. 1, FIG. 2 and FIG. 3, a first direction Y and a second direction X are defined to be perpendicular to each other, and the first direction Y and the second direction X are perpendicular to the vertical direction Z. The insulating body 1 has multiple accommodating cavities 10 for correspondingly accommodating multiple terminals C. The accommodating cavities 10 are arranged to form multiple first rows A and multiple second rows B provided in the first direction Y alternately at intervals. Two adjacent first rows A align with each other in parallel in the first direction Y, and two adjacent second rows B align with each other in parallel in the first direction Y. Each first row A and the adjacent second row B are provided staggeredly in parallel in the first direction Y, and in the second direction X, a projection of each accommodating cavity 10 in the first row A and a projection of the adjacent accommodating cavity in the second row B are overlapped.

Referring to FIG. 1, FIG. 2 and FIG. 3, each accommodating cavity 10 runs through an upper surface and a lower surface of the insulating body 1. Each accommodating cavity 10 has a first cavity 101 and a second cavity 102 communicated with each other in the first direction Y and provided in rectangular shapes. A width of the first cavity 101 is greater than a width of the second cavity 102, and both the first cavity 101 and the second cavity 102 run through the upper and lower surfaces of the insulating body 1. The first cavity 101 and the second cavity 102 are used to jointly accommodate one of the terminals C. Multiple retaining slots 103 extend upward from the lower surface of the insulating body 1 and do not run through the upper surface of the insulating body 1, and each retaining slot 103 and the corresponding first cavity 101 crisscross in a "+" shape. A height of the retaining slot 103 is roughly one third of a height of the insulating body 1. A positioning block 104 is protrudingly provided on an inner wall of the second cavity 102, and is used to position the terminal C in the vertical direction Z.

Referring to FIG. 1, FIG. 2 and FIG. 3, multiple first cavities 101 in each first row A and multiple second cavities 102 in the adjacent second row B are overlapped with their projections in the second direction X and are disposed alternately. Compared with a parallel aligned arrangement, the alternate design allows more accommodating cavities 10 to be formed on the insulating body 1 of the same size, such that more terminals C can be accommodated, thereby improving the electrical performance of the electrical connector 100. Each second cavity 102 is equally distanced from the first cavities 101 on the two adjacent sides, and the distance is substantially equal to the width of the second cavity 102, thereby ensuring the structural strength of the insulating body 1, and avoiding insufficient strength of the insulating body 1 caused by uneven wall thickness between the accommodating cavities 10. The width of the second cavity 102 is smaller than the width of the first cavity 101.

Compared with the case where the first cavity 101 and the second cavity 102 have the same width, in the present embodiment, the wall between the first cavity 101 and the adjacent second cavity 102 is thickened, thus facilitating an increase of the strength of the insulating body 1.

Figure 4:
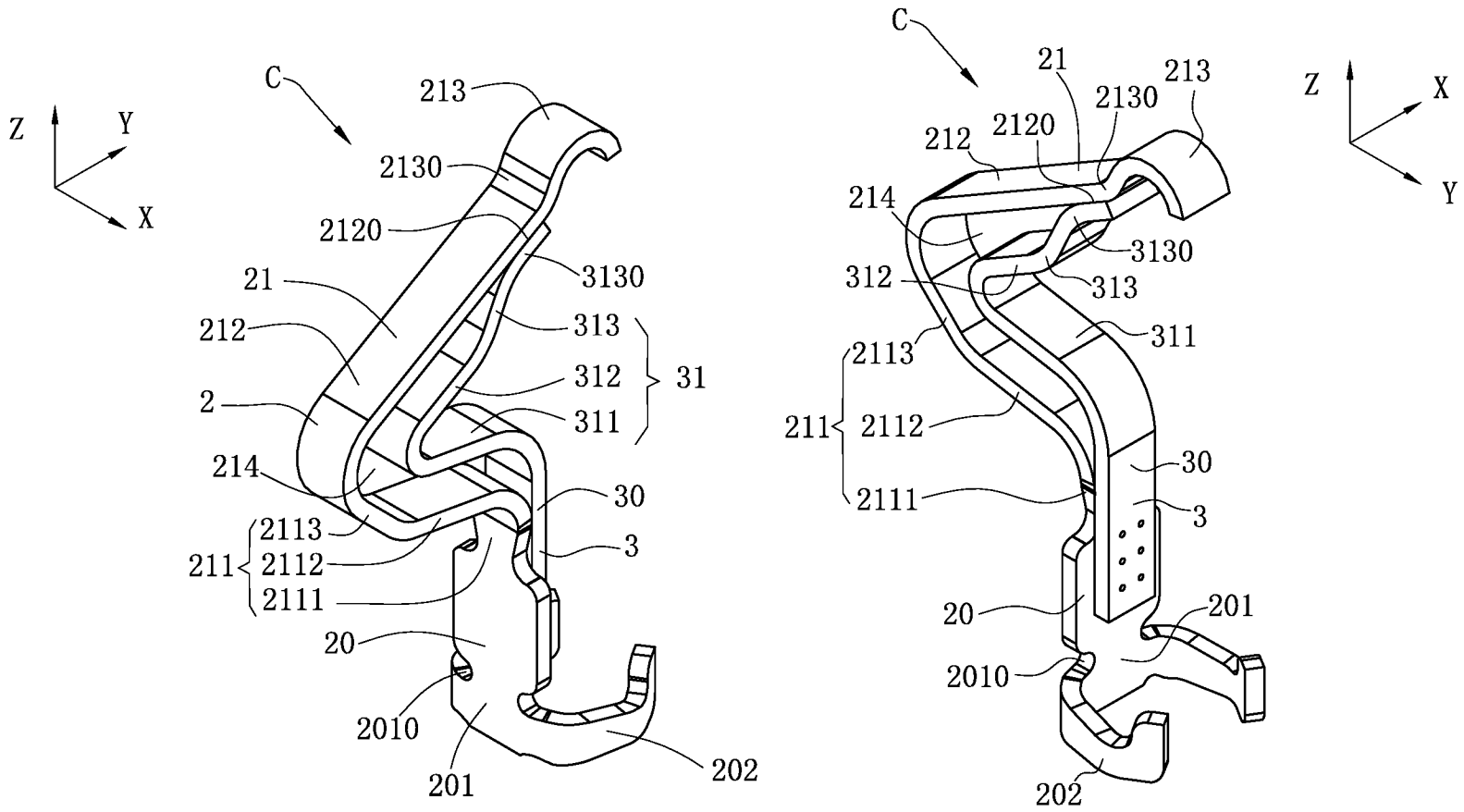
FIG. 4 is a perspective view of a terminal in FIG. 3.

Referring to FIG. 1, FIG. 3 and FIG. 4, each terminal C is formed by a first terminal 2 and a second terminal 3, which are independent from each other. The first terminal 2 and the second terminal 3 are punched from a same conductive metal sheet material. The first terminal 2 and the second terminal 3 are accommodated in the same accommodating cavity 10.

Figure 5:
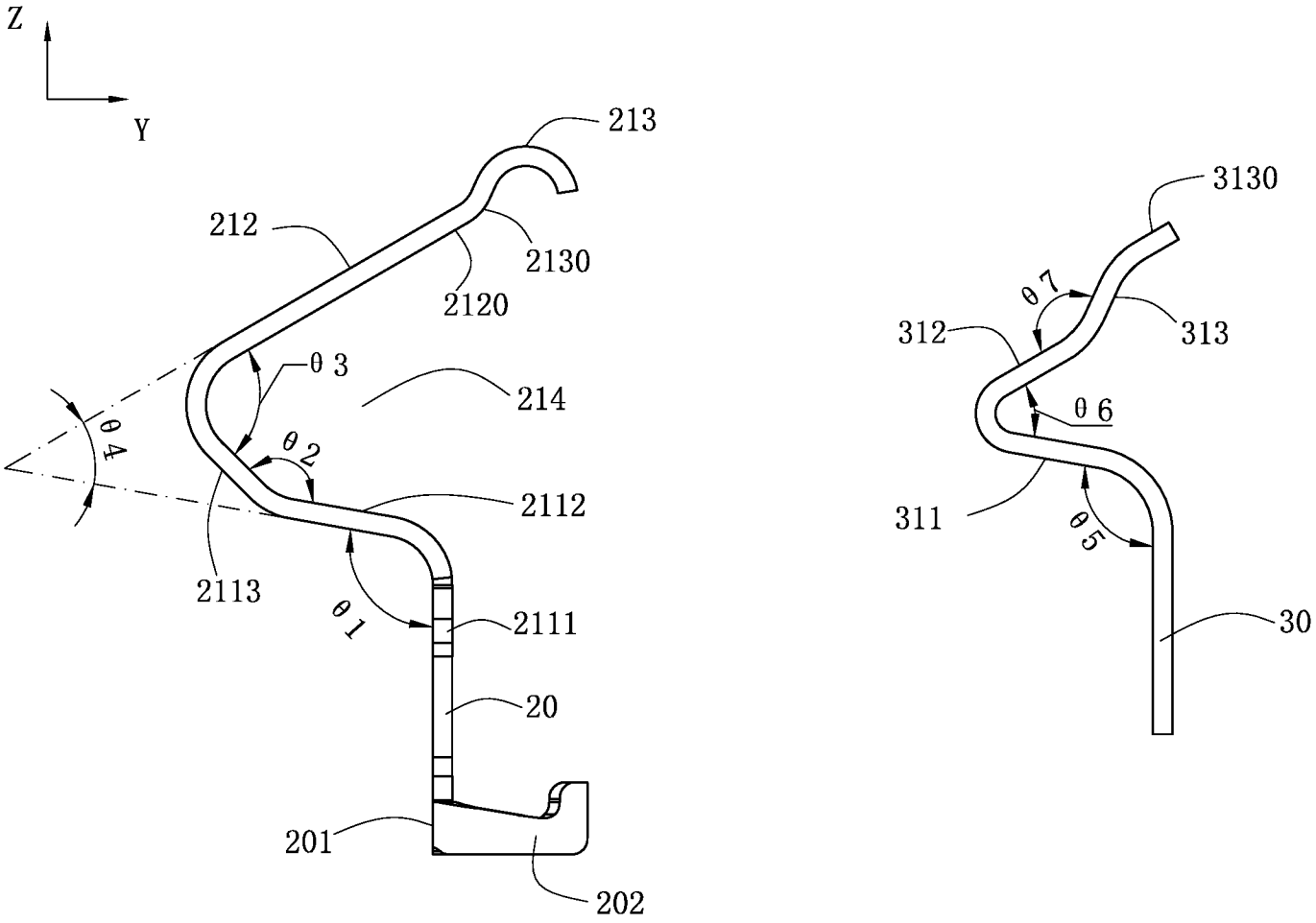
FIG. 5 is an exploded plain view of the terminal in FIG. 4.

Referring to FIG. 1, FIG. 4 and FIG. 5, the first terminal 2 has a first base 20, and the first base 20 has two vertical plate surfaces and is fixed into the retaining slot 103. The first base 20 determines a left-right direction Y and a width direction X perpendicular to each other. The left-right direction Y is perpendicular to the plate surface of the first base 20, and the vertical plate surfaces of the first base 20 are parallel to the width direction X.

Referring to FIG. 3, FIG. 4 and FIG. 5, a first elastic arm 21 extends upward from the first base 20, and the first elastic arm 21 has a first portion 211 bending upward from the first base 20 and extending leftward. The first portion 211 has a first section 2111, a second section 2112 and a third section 2113. The first section 2111 is vertically provided, and is connected downward with the first base 20. The second section 2112 bends and extends upward and leftward from the first section 2111, and a first angle θ1 between the first section 2111 and the second section 2112 is 100°, or substantially equal to 100°. The third section 2113 bends and extends upward and leftward from the second section 2112, and a second angle θ2 formed between the third section 2113 and the second section 2112 is 145°, or substantially equal to 145°. The first elastic arm 21 has a second portion 212 bending and extending upward reversely from the third section 2113, such that a third angle θ3 formed between the second portion 212 and the third section 2113 is 75°, or substantially equal to 75°. The second angle θ2 is 145°, or substantially equal to 145°, and the third angle θ3 is equal to 75°, or substantially equal to 75°, such that a fourth angle θ4 formed between an extending line of the second portion 212 and an extending line of the second section 2112 is 40°, or substantially equal to 40°.

Referring to FIG. 3, FIG. 4 and FIG. 5, the second portion 212 passes beyond a right plate surface of the first base 20 rightward from left. The second portion 212 has a abutting region 2120, and the abutting region 2120 faces the second terminal 3 to be abutted by the second terminal 3. A contact portion 213 bends and extends upward from the second portion 212, and the contact portion 213 is used to be in electrical contact with the chip module 200. A connecting location 2130 connecting the second portion 212 and the contact portion 213 is a upward-bent shape, and the connecting location 2130 is adjacent to the abutting region 2120, such that an abutting location between the abutting region 2120 and the second terminal 3 is located close to the contact portion 213. Compared with the case where the connecting location is not adjacent to the abutting portion, the present embodiment increases the parallel portions of the terminal C, thereby reducing the impedance of the terminal C. The first portion 211 and the contact portion 213 are located at a left side and a right side of the first base 20. The second portion 212 is mostly located on the left side of the first base 20, and the connecting location 2130 is located on the right side of the first base 20. Thus, when the contact portion 213 is abutted by the chip module 200, the first portion 211 and the second portion 212 located on the left side of the first base 20 as well as the contact portion 213 may absorb an acting force of the chip module 200 in the left-right direction Y, thereby avoiding turnover deflection of the terminal C due to an unbalanced stress in the left-right direction Y, which may then affect the abutting contact between the contact portion 213 and the chip module 200. The first portion 211 and the second portion 212 form an accommodating space 214 recessing toward the left side of the first base 20 to accommodate a portion of the second terminal 3.

Referring to FIG. 3, FIG. 4 and FIG. 5, a lower end of the first base 20 is provided with a first conduction portion 201, which is used to attach to the solder 4. The terminal C is fixedly soldered to the gasket 310 through the solder 4, so as to be electrically connected to the circuit board 300. In the related art, a connecting portion extends laterally from the base, and a conduction portion extends downward from the connecting portion, such that a main elastic arm and the conduction portion are staggeredly provided. In the present embodiment, the first conduction portion 201 and the first elastic arm 21 pass through a central surface of the first base 20 in the vertical direction Z, and a projection of the first conduction portion 201 and a projection of the first section 2111 are overlapped in the vertical direction Z, such that a connecting line between the first conduction portion 201 and the first section 2111 is a vertical line perpendicular to the circuit board 300, thereby allowing the electrical signals to be straightly transmitted. Compared with the related art, the present embodiment enables the electrical signals to be directly conducted to the circuit board 300 from the first base 20 which is vertically provided, so as to shorten a transmission path for the electrical signals.

A groove 2010 is concavely provided at each of two sides of the first conduction portion 201 in the width direction X. The grooves 2010 are located above the solder 4 to accommodate the molten solder 4, so as to prevent the molten solder 4 from climbing upward to the first base 20. A clamping arm 202 extends from each of the two sides of the first conduction portion 201 in the width direction X, and the two clamping arms 202 and the first conduction portion 201 jointly clamp the solder 4.

Referring to FIG. 3, FIG. 4 and FIG. 5, the second terminal 3 has a second base 30, and the second base 30 is attached to and fixed to the right plate surface of the first base 20 by soldering. A second elastic arm 31 extends upward from the second base 30, and the second elastic arm 31 is formed by a third portion 311, a fourth portion 312 and a fifth portion 313. The third portion 311 bends and extends upward and leftward from the second base 30, and a fifth angle θ5 formed between the third portion 311 and the second base 30 is 100°, or substantially equal to 100°. The fourth portion 312 bends upward reversely from the third portion 311, and a sixth angle θ6 formed between the fourth portion 312 and the third portion 311 is 40°, or substantially equal to 40°. The fifth portion 313 extends upward and rightward from the fourth portion 312, and a seventh angle θ7 formed between the fifth portion 313 and the fourth portion 312 is 145°, or substantially equal to 145°. The fifth portion 313 has a free tail end, which is an abutting portion 3130, facing the abutting region 2120 and attached to and abutting the abutting region 2120 upward. Since the fifth portion 313 is provided to bend upward to the fourth portion 312, the abutting portion 3130 exerts an upward pre-pressure on the abutting region 2120, such that the abutting portion 3130 is tightly attached to the abutting region 2120. When the first elastic arm 21 is subjected to an external force, such as during a transportation or mounting process, the first elastic arm 21 will slightly vibrate to cause a slight displacement. Since the abutting portion 3130 is tightly attached to the abutting region 2120 upward, the two components do not separate due to the slight vibration of the first elastic arm 21, thereby ensuring the electrical performance of the electrical connector 100.

Referring to FIG. 3, FIG. 4 and FIG. 5, the second portion 30 is attached and soldered to the first base 20 and the right plate surface of the first section 2111. The third portion 311, the fourth portion 312 and the fifth portion 313 are accommodated in the accommodating space 214. The first portion 211 and the third portion 311 are provided face-to-face, and the second portion 212 and the fourth portion 312 as well as the fifth portion 313 are provided face-to-face. The abutting portion 3130 is located below the abutting region 2120 and upward abuts the abutting region 2120. Dual conductive channels that are provided in parallel are formed from an abutting location between the first terminal 2 and the second terminal 3 to a soldering location therebetween. The parallel connection of the dual conductive channels reduces the electrical impedance of the terminal C and facilitates transmission of a large current. The abutting location and the soldering location align with each other in the vertical direction Z, so as to increase the strength of the terminal C.

Referring to FIG. 3, FIG. 4 and FIG. 5, since the first angle θ1 is equal to the fifth angle θ5, the second section 2112 is parallel to the third portion 311, and a first distance L1 is formed therebetween. Since the fourth angle θ4 is equal to the sixth angle θ6, the third portion 311 is parallel to the fourth portion 312, and a second distance L2 is formed therebetween.

A connecting portion between the first portion 211 and the second portion 212 and a connecting portion between the third portion 311 and the fourth portion 312 align with each other in the left-right direction Y, such that the first distance L1 is equal to the second distance L2. Such design allows the distance between the dual channels of the terminal C to be maintained even. If there is a rapid increase or decrease of the distance between the dual conductive channels, a magnetic field between the dual conductive channels is uneven, causing transmission losses of the electrical signals. In the present embodiment, the distance between the dual conductive channels is maintained to be substantially equal, thereby reducing the transmission losses of the electrical signals.

After fixing and soldering, the first terminals 2 and the second terminals 3 are mounted in the accommodating cavities 10. The contact portion 213 is located above the insulating body 1 to abut and be in contact to the chip module 200. The abutting region 2120 and the abutting portion 3130 are located above the insulating body 1. The first conduction portion 201 are exposed below the insulating body 1. The solder 4 attached to the first conduction portion 201 is located below the insulating body 1, allowing the electrical connector 100 to be easily mounted on the circuit board 300.

Referring to FIG. 1, FIG. 3 and FIG. 4, the first base 20 is fixedly accommodated in the retaining slot 103. The first portion 211 is accommodated across the first cavity 101 and the second cavity 102 leftward from right, and the second portion 212 is accommodated across the second cavity 102 and the first cavity 101 rightward from left and extends from the first cavity 101 to be above the insulating body 1. A connecting portion between the first portion 211 and the second portion 212 is located above the positioning block 104, and projections thereof are overlapped in the vertical direction Z, such that the positioning block 104 may prevent the first elastic arm 21 from excessive elastic deformation displacement in the vertical direction Z when the first elastic arm 21 is abutted downward by the chip module 200, thereby protecting the elastic properties of the first elastic arm 21, and facilitating the abutting stability between the first elastic arm 21 and the chip module 200. The first portion 211 is exposed on the lower surface of the insulating body 1 through the second cavity 102, the second portion 212 is exposed on the lower surface of the insulating body 1 through the second cavity 102, and air circulates on the upper and lower surfaces of the insulating body 1, so as to facilitate heat dissipation of the terminal C.

Figure 6:
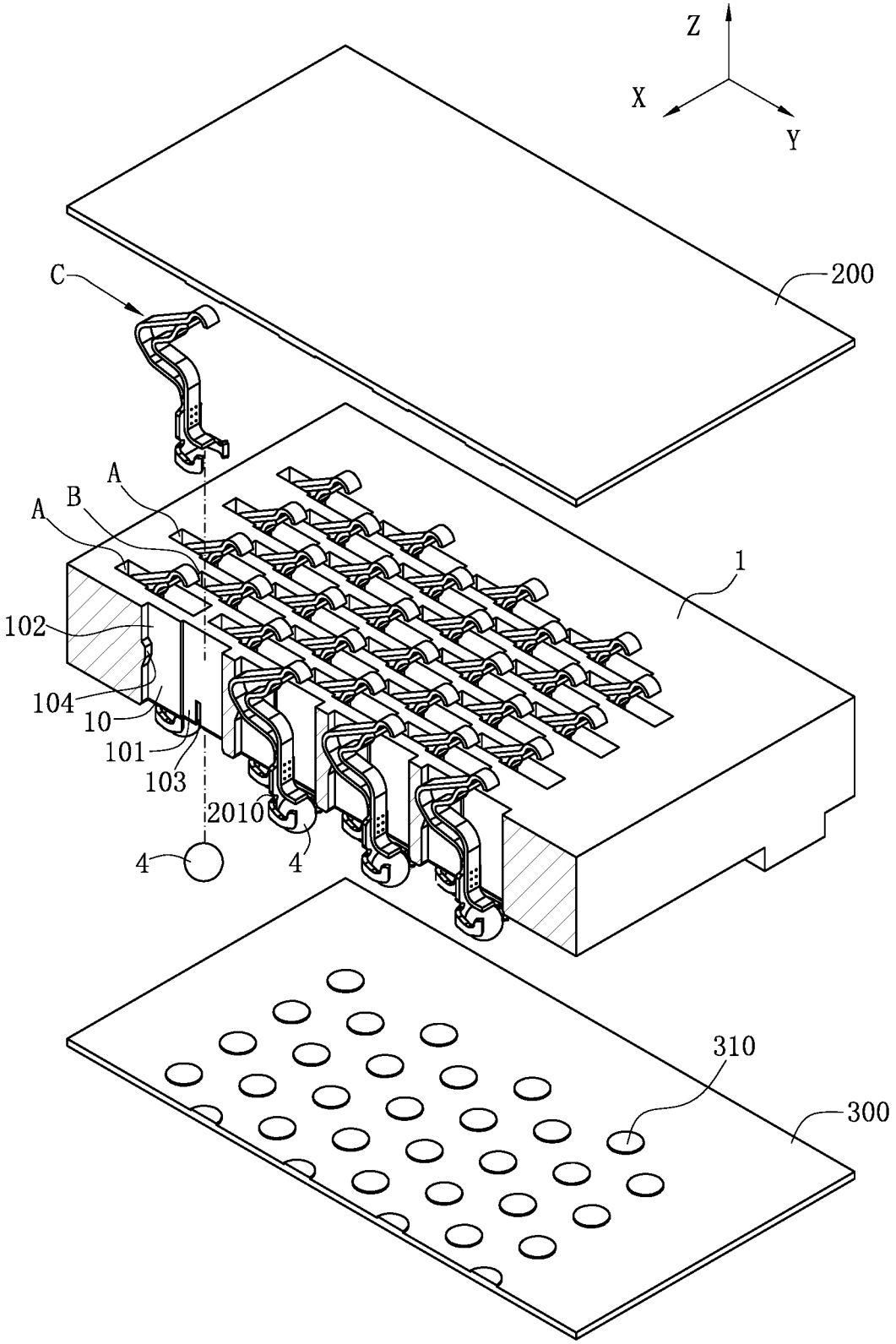
FIG. 6 is a perspective sectional view of an electrical connector, a circuit board and a chip module according to a second embodiment of the present invention.
Figure 7:
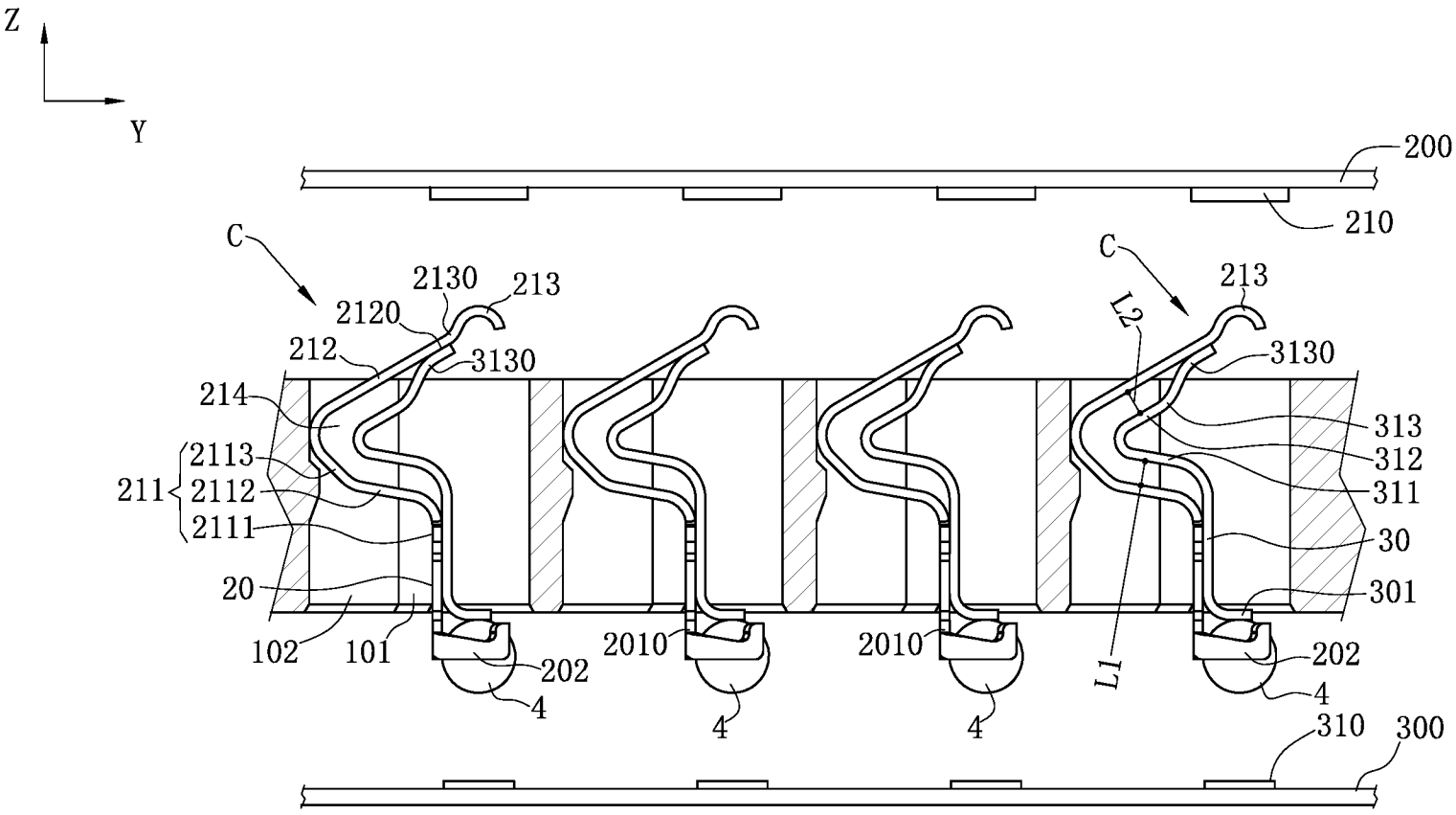
FIG. 7 is a plain sectional view of the electrical connector in FIG. 6.
Figure 8:
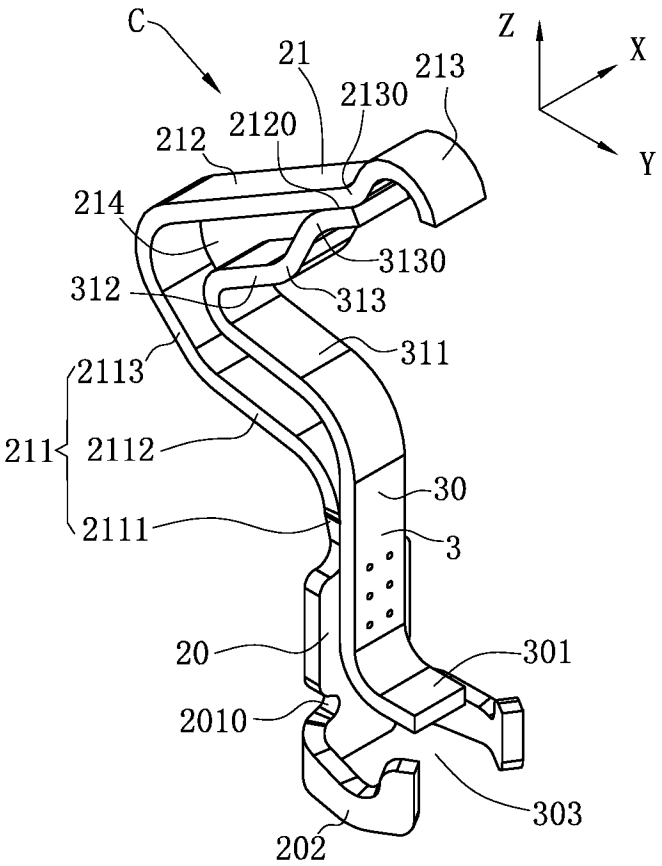
FIG. 8 is a perspective view of a terminal in FIG. 6.
Figure 8:
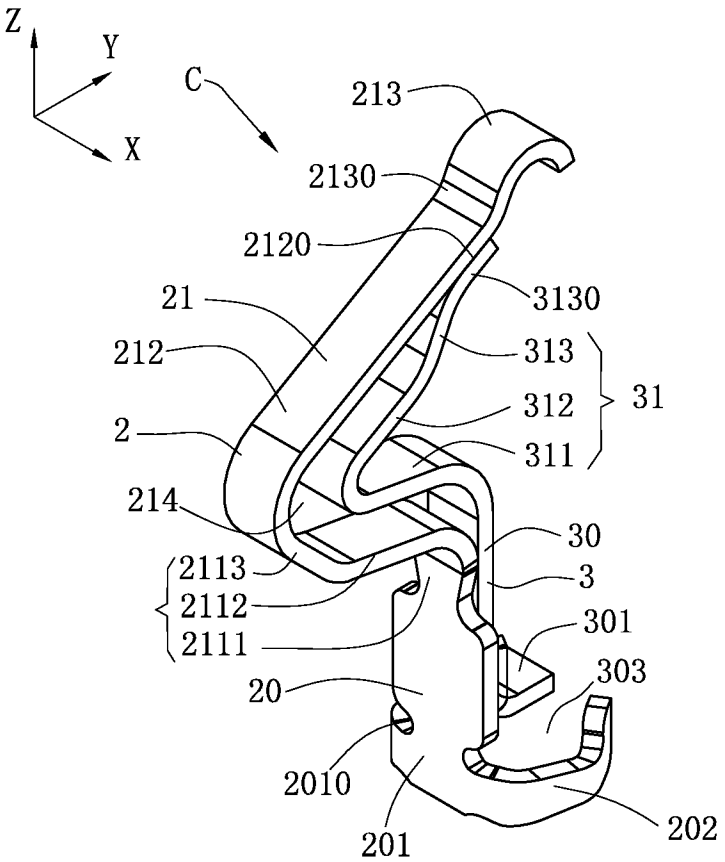

FIG. 6, FIG. 7 and FIG. 8 show a second embodiment of the present invention, which is different from the first embodiment in that: a second conduction portion 301 bends and extends downward from the second base 30, and a lower plate surface thereof is used to attach to the solder 4. The first conduction portion 201, the second conduction portion 301 and the two clamping arms 202 jointly form a clamping space 303, and the solder 4 is accommodated in the clamping space 303. The first conduction portion 201 and the second conduction portion 301 of the same terminal C are attached to the same solder 4. The solder 4 fixes the terminal C to the gasket 310 by soldering, and electrical signals may be transmitted to the circuit board 300 from the first conduction portion 201 and the second conduction portion 301, thereby improving the reliability of the electrical performance.

Figure 9:
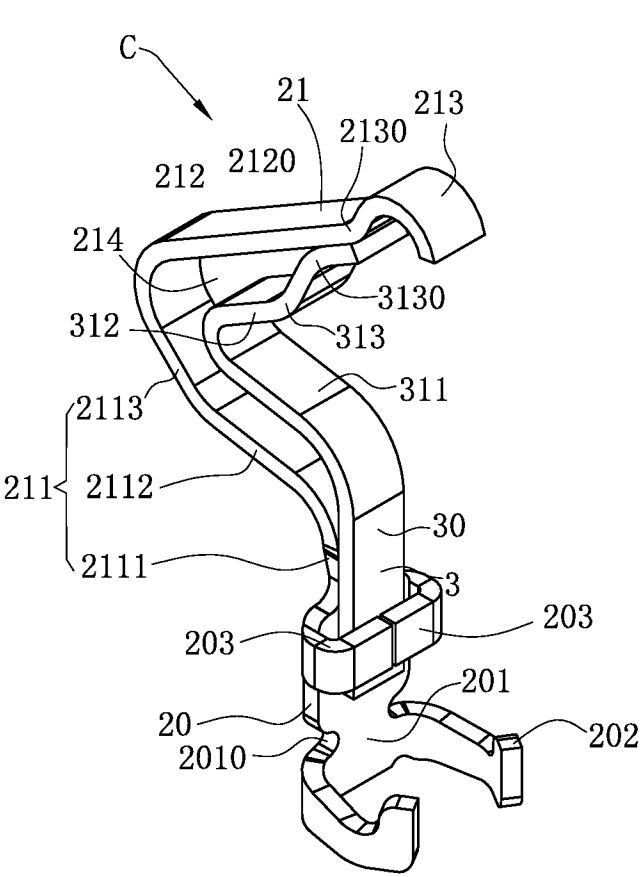
FIG. 9 is a perspective view of a terminal according to a third embodiment of the present invention.

FIG. 9 shows a perspective view of the terminal C according to a third embodiment of the present invention. The difference between the terminal C in the third embodiment and the terminal C in the first embodiment exists in that: an embracing arm 203 extends from each of two sides of the first base 20 in the width direction X respectively in the third embodiment, and the two embracing arms 203 are tightly attached to the second base 30 to form two fixing structures to fix and attach the first base 20 and the second base 30 together.

Figure 10:
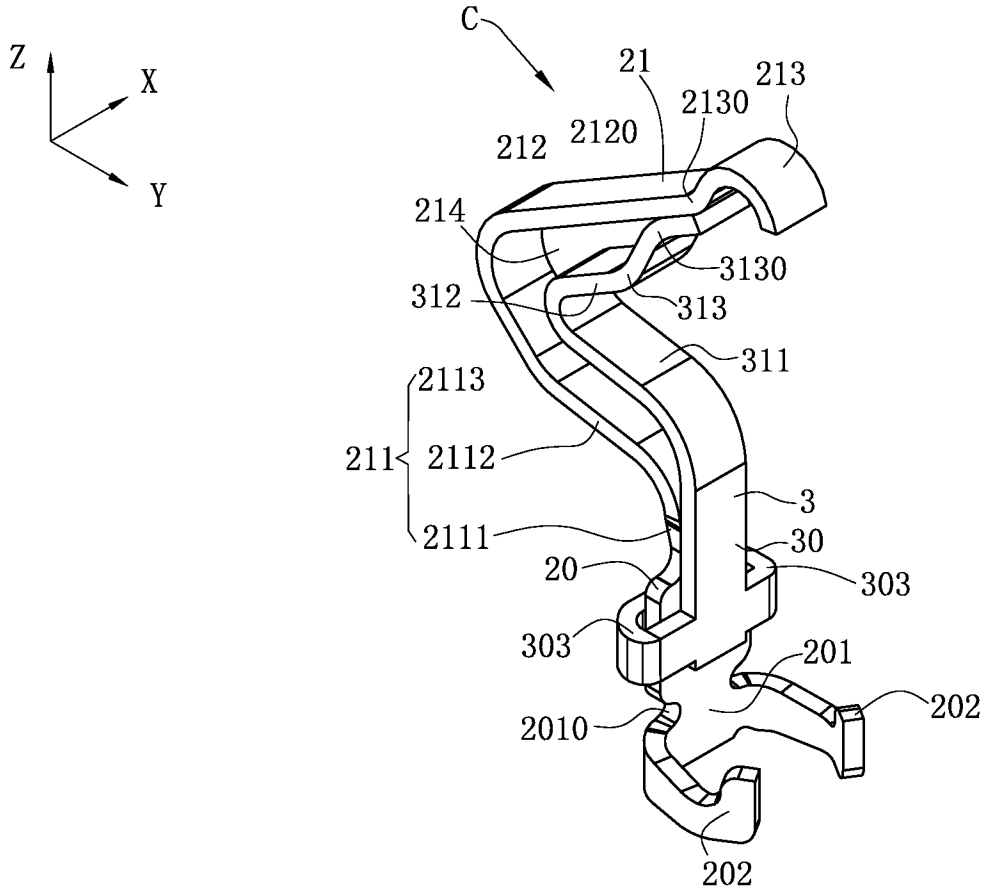
FIG. 10 is a perspective view of a terminal according to a fourth embodiment of the present invention.

FIG. 10 shows a perspective view of the terminal C according to a fourth embodiment of the present invention. The difference between the terminal C in the fourth embodiment and the terminal C in the third embodiment exists in that: an embracing arm 203 extends from each of two sides of the second base 30 in the width direction X respectively in the fourth embodiment, and the two embracing arms 203 are tightly attached to the first base 20 to form two fixing structures to fix and attach the first base 20 and the second base 30 together.

To sum up, the electrical connector 100 according to certain embodiments of the present invention has the following beneficial effects:

1. In the related art, a connecting portion extends laterally from the base, and a conduction portion extends downward from the connecting portion, such that a main elastic arm and the conduction portion are staggeredly provided. In the present embodiment, the first conduction portion 201 and the first elastic arm 21 pass through a central surface of the first base 20 in the vertical direction Z, and a projection of the first conduction portion 201 and a projection of the first section 2111 are overlapped in the vertical direction Z, such that a connecting line between the first conduction portion 201 and the first section 2111 is a vertical line perpendicular to the circuit board 300, thereby allowing the electrical signals to be straightly transmitted. Compared with the related art, the present embodiment enables the electrical signals to be directly conducted to the circuit board 300 from the first base 20 which is vertically provided, so as to shorten a transmission path for the electrical signals.

2. The fifth portion 313 has a free tail end, which is an abutting portion 3130, facing the abutting region 2120 and attached to and supporting the abutting region 2120 upward. Since the fifth portion 313 is provided to bend upward to the fourth portion 312, the abutting portion 3130 exerts an upward pre-pressure on the abutting region 2120, such that the abutting portion 3130 is tightly attached to the abutting region 2120. When the first elastic arm 21 is subjected to an external force, such as during a transportation or mounting process, the first elastic arm 21 will slightly vibrate to cause a slight displacement. Since the abutting portion 3130 is tightly attached to the abutting region 2120 upward, the two components do not separate due to the slight vibration of the first elastic arm 21, thereby ensuring the terminal C to have dual channels to transmit the signals, and ensuring the electrical performance of the electrical connector 100.

3. The connecting location 2130 is adjacent to the abutting region 2120, such that an abutting location between the abutting region 2120 and the second terminal 3 is located close to the contact portion 213. Compared with the case where the connecting location is not adjacent to the abutting portion, the present embodiment increases the parallel portions of the terminal C, thereby reducing the impedance of the terminal C.

4. The second portion 30 is attached and soldered to the first base 20 and the right plate surface of the first section 2111. The third portion 311, the fourth portion 312 and the fifth portion 313 are accommodated in the accommodating space 214. The first portion 211 and the third portion 311 are provided face-to-face, and the second portion 212 and the fourth portion 312 as well as the fifth portion 313 are provided face-to-face. The abutting portion 3130 is located below the abutting region 2120 and upward support the abutting region 2120. Dual conductive channels that are provided in parallel are formed from an abutting location between the first terminal 2 and the second terminal 3 to a soldering location therebetween. The parallel connection of the dual conductive channels reduces the electrical impedance of the terminal C and facilitates transmission of a large current.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connect an electronic component to a circuit board, the electrical connector comprising:

an insulating body;

at least one first terminal, having a first base accommodated in the insulating body and a first elastic arm extending upward from the first base, wherein the first elastic arm is configured to abut the electronic component, the first elastic arm has a first portion and a second portion sequentially from the first base, the first portion bends and extends upward from the first base toward one side, the second portion bends and extends upward reversely from the first portion, and the first portion and the second portion form an accommodating space; and at least one second terminal, having a second base soldered and fixed to the first base, and a second elastic arm extending from the second base toward the first elastic arm, wherein the second elastic arm upward abuts the first elastic arm, the second elastic arm has a third portion and a fourth portion, the third portion bends and extends upward from the second base, the fourth portion bends reversely and extends upward from the third portion, and the third portion and the fourth portion are at least partially accommodated in the accommodating space;

wherein a lower end of the first base is provided with a first conduction portion configured to be electrically connected to the circuit board, and a projection of the first conduction portion and a projection of the first elastic arm in a vertical direction are at least partially overlapped.

2. The electrical connector according to claim 1, wherein the first portion and the third portion are provided at least partially in parallel and spaced from each other to determine a first distance therebetween.

3. The electrical connector according to claim 2, wherein the second portion and the fourth portion are provided at least partially in parallel and spaced from each other to determine a second distance therebetween.

4. The electrical connector according to claim 3, wherein the first distance is same as the second distance.

5. The electrical connector according to claim 1, wherein the first elastic arm has an abutting region, the second elastic arm further has an abutting portion bending and extending upward from the fourth portion, and the abutting portion upward abuts the abutting region.

6. The electrical connector according to claim 5, wherein the first elastic arm further has a contact portion bending and extending upward from the second portion, and the abutting portion is provided adjacent to the contact portion.

7. The electrical connector according to claim 6, wherein the abutting region is provided on the second portion.

8. The electrical connector according to claim 1, wherein each of two sides of the first conduction portion is provided with at least one groove, a solder is attached to the first conduction portion, and the groove is located above the solder to accommodate a partially molten solder, to prevent the partially molten solder from climbing upward to the first base or the second base.

9. An electrical connector, configured to electrically connect an electronic component to a circuit board, the electrical connector comprising:

an insulating body;

at least one first terminal, having a first base accommodated in the insulating body and a first elastic arm extending upward from the first base, wherein the first elastic arm is configured to abut the electronic component, the first elastic arm has a first portion and a second portion sequentially from the first base, the first portion bends and extends upward from the first base toward one side, the second portion bends and extends upward reversely from the first portion, and the first portion and the second portion form an accommodating space; and at least one second terminal, having a second base fixed to the first base, and a second elastic arm extending from the second base toward the first elastic arm, wherein the second elastic arm upward abuts the first elastic arm;

wherein a lower end of the second base is provided with a conduction portion configured to be electrically connected to the circuit board, and a projection of the conduction portion of the second base and a projection of the second elastic arm in a vertical direction are at least partially overlapped.

10. The electrical connector according to claim 9, wherein a lower end of the first base is downward provided with a conduction portion, and the conduction portion of the first base and the conduction portion of the second base are attached to a same solder configured to be electrically connected to the circuit board.

11. The electrical connector according to claim 10, wherein at least one clamping arm extends from the conduction portion of the first base, the clamping arm, the conduction portion of the first base and the conduction portion of the second base define a clamping space, and the solder is located in the clamping space.

12. The electrical connector according to claim 9, wherein the second elastic arm has a third portion and a fourth portion, the third portion bends and extends upward from the second base, the fourth portion bends reversely and extends upward from the third portion, and the third portion and the fourth portion are at least partially accommodated in the accommodating space.

13. The electrical connector according to claim 12, wherein the first elastic arm has an abutting region, the second elastic arm further has an abutting portion bending and extending upward from the fourth portion, and the abutting portion upward abuts the abutting region.

14. An electrical connector, configured to electrically connect an electronic component to a circuit board, the electrical connector comprising:

an insulating body;

at least one first terminal, having a first base accommodated in the insulating body and a first elastic arm extending upward from the first base, wherein the first elastic arm is configured to abut the electronic component, the first elastic arm has a first portion and a second portion sequentially from the first base, the first portion bends and extends upward from the first base toward one side, the second portion bends and extends upward reversely from the first portion, and the first portion and the second portion form an accommodating space;

at least one second terminal, having a second base and a second elastic arm extending from the second base toward the first elastic arm, wherein the second elastic arm upward abuts the first elastic arm, the second elastic arm has a third portion and a fourth portion, the third portion bends and extends upward from the second base, the fourth portion bends reversely and extends upward from the third portion, and the third portion and the fourth portion are at least partially accommodated in the accommodating space; and two fixing structures, configured to fix the first base and the second base, wherein the first base and the second base are located between the two fixing structures;

wherein the first elastic arm has an abutting region, the second elastic arm further has an abutting portion bending and extending upward from the fourth portion, and the abutting portion upward abuts the abutting region; and wherein a lower end of the first base is provided with a first conduction portion configured to be electrically connected to the circuit board, and a projection of the first conduction portion and a projection of the first elastic arm in a vertical direction are at least partially overlapped.

15. The electrical connector according to claim 14, wherein two embracing arms respectively extend from two sides of the first base, and the two embracing arms fix the second base so as to form the two fixing structures.

16. The electrical connector according to claim 14, wherein two embracing arms respectively extend from two sides of the second base, and the two embracing arms fixes the first base so as to form the two fixing structures.

* * * * *